US009903145B2

(12) United States Patent
Huber et al.

(10) Patent No.: US 9,903,145 B2
(45) Date of Patent: Feb. 27, 2018

(54) ADJUSTING DRIVE FOR FURNITURE FLAPS

(71) Applicant: Julius Blum GmbH, Hoechst (AT)

(72) Inventors: Edgar Huber, Hard (AT); Harald Nussbichler, Bregenz (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/260,931

(22) Filed: Sep. 9, 2016

(65) Prior Publication Data

US 2016/0376823 A1 Dec. 29, 2016

Related U.S. Application Data

(63) Continuation of application No. PCT/AT2015/000028, filed on Feb. 19, 2015.

(30) Foreign Application Priority Data

Mar. 14, 2014 (AT) ..... A 183/2014

(51) Int. Cl.
*A47B 96/00* (2006.01)
*E05F 1/10* (2006.01)

(52) U.S. Cl.
CPC ..... *E05F 1/105* (2013.01); *A47B 96/00* (2013.01); *E05F 1/1058* (2013.01); *E05Y 2201/638* (2013.01); *E05Y 2900/20* (2013.01)

(58) Field of Classification Search
CPC ..... E05F 1/105; A47B 96/00; E05Y 2900/20
(Continued)

(56) References Cited

U.S. PATENT DOCUMENTS 3,763,519 A * 10/1973 Favre ..... E05F 1/105 16/72
4,801,931 A * 1/1989 Schmidt ..... G06F 3/03549 345/164
(Continued)

FOREIGN PATENT DOCUMENTS

AT 513487 * 4/2014
AT 514585 * 2/2015
(Continued)

OTHER PUBLICATIONS

Search Report dated Apr. 19, 2017 in corresponding Chinese Application No. 201580011250.8.
(Continued)

*Primary Examiner* — Janet M Wilkens
(74) *Attorney, Agent, or Firm* — Wenderoth, Lind & Ponack, L.L.P.

(57) ABSTRACT

An actuating drive includes an actuating arm pivotally mounted about a pivoting axis for moving the movable furniture part, a spring device for applying a force onto the actuating arm, and a transmission mechanism for transmitting a force of the spring device onto the actuating arm. The transmission mechanism includes an actuating portion movement-coupled to the actuating arm, a setting contour, and a pressure portion pressurized by the spring device. The pressure portion is a rotatably mounted pressure roller for running along the setting contour. The setting contour is arranged between the actuating portion and the pressure roller, and the setting contour is on a contour portion separate from the actuating portion. The contour portion has a fastening section configured to rest against the actuating portion and a limb protruding transversely from the fastening section, and the setting contour is a curved outer surface of the limb.

17 Claims, 6 Drawing Sheets

(58) Field of Classification Search
USPC ..... 312/319.2, 328, 327, 319.3; 16/286; 49/386, 246, 248
See application file for complete search history.

(56) References Cited

U.S. PATENT DOCUMENTS

| | | | | | |
|---|---|---|---|---|---|
| 5,884,385 | A * | 3/1999 | Quintile | A47C 21/026 | 29/513 |
| 5,904,411 | A * | 5/1999 | Hayakawa | E05D 15/582 | 16/289 |
| 7,178,202 | B2 * | 2/2007 | Hirtsiefer | E05D 3/14 | 16/286 |
| 7,448,703 | B2 * | 11/2008 | Kung | E05D 15/262 | 162/286 |
| 7,500,287 | B2 * | 3/2009 | Brüstle | E05F 1/1075 | 16/286 |
| 2004/0239213 | A1 * | 12/2004 | Hirtsiefer | E05D 15/262 | 312/109 |
| 2006/0279092 | A1 | 12/2006 | Hirtsiefer | | |
| 2007/0124893 | A1 | 6/2007 | Brustle | | |
| 2009/0064457 | A1 | 3/2009 | Brustle | | |
| 2010/0162847 | A1 | 7/2010 | Gassner | | |
| 2011/0138960 | A1 | 6/2011 | Omann et al. | | |
| 2015/0351539 | A1 * | 12/2015 | Baldreich | E05D 11/1064 | 312/319.2 |
| 2016/0160551 | A1 * | 6/2016 | Lutz | E05D 11/1064 | 74/469 |

FOREIGN PATENT DOCUMENTS

| | | | |
|---|---|---|---|
| AT | 515492 | * | 9/2015 |
| CN | 101809245 | | 8/2010 |
| DE | 10 2004 019 785 | | 11/2005 |
| DE | 10 2006 014 493 | | 10/2007 |
| EP | 2 003 276 | | 12/2008 |
| GB | 164160 | * | 6/1921 |
| JP | 56-175538 | | 5/1980 |
| RU | 2 495 989 | | 10/2013 |
| WO | 2004/104339 | | 12/2004 |
| WO | 2010097996 | * | 9/2010 |

OTHER PUBLICATIONS

International Search Report dated Jun. 22, 2015 in International (PCT) Application No. PCT/AT2015/000028.
Search Report dated Dec. 5, 2014 in Austrian Application No. A 183/2014, with English translation.
English translation of Notification of Reasons for Refusal dated Jul. 25, 2017 in Japanese Application No. 2016-547171.

* cited by examiner

ADJUSTING DRIVE FOR FURNITURE FLAPS

BACKGROUND OF THE INVENTION

The present invention relates to an actuating drive for moving a movable furniture part, including an actuating arm pivotally mounted about a pivoting axis for moving the movable furniture part, a spring device for applying a force onto the actuating arm, and a transmission mechanism for transmitting a force of the spring device onto the actuating arm. The transmission mechanism includes an actuating portion movement-coupled to the actuating arm, a setting contour, and a pressure portion pressurized by the spring device. The pressure portion is in the form of a rotatably mounted pressure roller which can run along the setting contour upon a movement of the actuating arm, and the setting contour is arranged between the actuating portion and the pressure roller.

The invention further relates to an arrangement having a movable furniture part and an actuating drive of the kind to be described.

Such an actuating drive is shown, for example, in DE 10 2006 014 493 A1. Here, a pivotally mounted actuating arm is rotatably mounted by a setting contour arranged on the actuating arm and a pressure portion in the form of a pressure roller abutting the setting contour. The setting contour of the actuating arm is formed by the material thickness of the actuating arm and additionally by disc portions arranged on both sides of the actuating arm (disc portions 30, 31 in FIG. 4). As a result of this three-part construction, the contact surface for the pressure roller is enlarged and thus the arising forces can be distributed over an enlarged area.

Usually, the setting contours of such actuating drives are produced by precision blanking or fine blanking, respectively. In other words, the setting contours are produced by a manufacturing process in which during a working operation, workpieces can be produced having a precise contour with smooth and rectangular cutting edges. An advantage of this technology in comparison with a usual punch technique is that by way of the achieved clean cut, a high surface quality can be attained so that a laborious post-treatment of the setting contours (for example polishing) can be omitted. A smooth surface of the setting contour is namely a necessary requirement because possible irregularities are negatively noticed by a user when opening and closing the movable furniture part. A disadvantage of the precision blanking is, however, the fact that this manufacturing process is relatively costly and only a low number of cutting cycles are permitted in serial production.

A further disadvantage of the known designs of setting contours is the fact that the running surface provided for the contact with the pressure roller is determined by the material thickness of the setting contour. Accordingly, relatively high material thicknesses must be provided in order for a sufficient stable abutting surface, which is partially pressurized by the spring device with very high pre-stressing forces, for the pressure roller to be obtained.

WO 2004/104339 A1 shows an actuating mechanism for furniture flaps, in which a pivotally mounted actuating arm on the end forming the setting contour has a surface which runs perpendicularly to the pivoting axis of the actuating arm. With relation to the pivoting axis, a bulge axially protrudes from this surface, and the bulge extends along the setting contour. Moreover, a guide shoe with a groove is provided which accommodates the bulge and which is guided along the bulge. Thus, the guide shoe flatly abuts against the bulge in order to avoid punctual contacts or line contacts with high surface pressure. However, the surface quality of the bulge does practically not matter at all, because possible irregularities of the bulge are compensated for by the flat contact of the guide shoe and do not have any influence on the movement behavior of the actuating arm.

SUMMARY OF THE INVENTION

It is an object of the present invention to propose an actuating drive of the kind mentioned in the introductory part of this specification, in which the manufacture of such a setting contour can be facilitated.

According to the invention, the setting contour is arranged on a contour portion which is separate from the actuating portion. The contour portion includes a fastening section configured to rest against the actuating portion and a limb extending transversely from the fastening section, and the setting contour is formed by a curved outer surface of the limb.

In other words, a contour portion is separate from the actuating portion, and the contour portion has a setting contour which serves in fact as an intermediate piece between the pressure roller and the actuating portion. Upon a movement of the actuating arm, the pressure roller does not run along a contour of the actuating portion which is movement-coupled to the actuating arm, but rather along a curved formed outer surface of the contour portion separate from the actuating portion.

According to an embodiment, the actuating portion which is movement-coupled to the actuating arm is pivotally mounted about a pivoting axis. The actuating portion, on the end region facing towards the pivoting axis, has a peripheral surface which is radially spaced in relation to the pivoting axis. The radially spaced peripheral surface is at least partially covered by the setting contour of the contour portion. Preferably, the setting contour forms a contact surface for the rotatably mounted pressure roller, and the contact surface runs parallel in relation to the pivoting axis of the actuating portion.

A particular advantage of the invention lies in the fact that the contour portion with the setting contour and also the actuating portion itself can be formed as a bending portion or as a deep-drawing portion, respectively. The deep-drawing is a known technique of sheet metal forming in which a flat metal portion is reshaped into a hollow body, without substantially changing the metal thickness. Thus, by way of relatively thin material thicknesses, contour portions and actuating portions with large and smooth surfaces can be produced which form the setting contour for the pressure portion.

BRIEF DESCRIPTION OF THE DRAWINGS

Further details and advantages of the present invention result from the embodiments shown in the Figures, in which.

DETAILED DESCRIPTION OF THE INVENTION

Figure 1A:
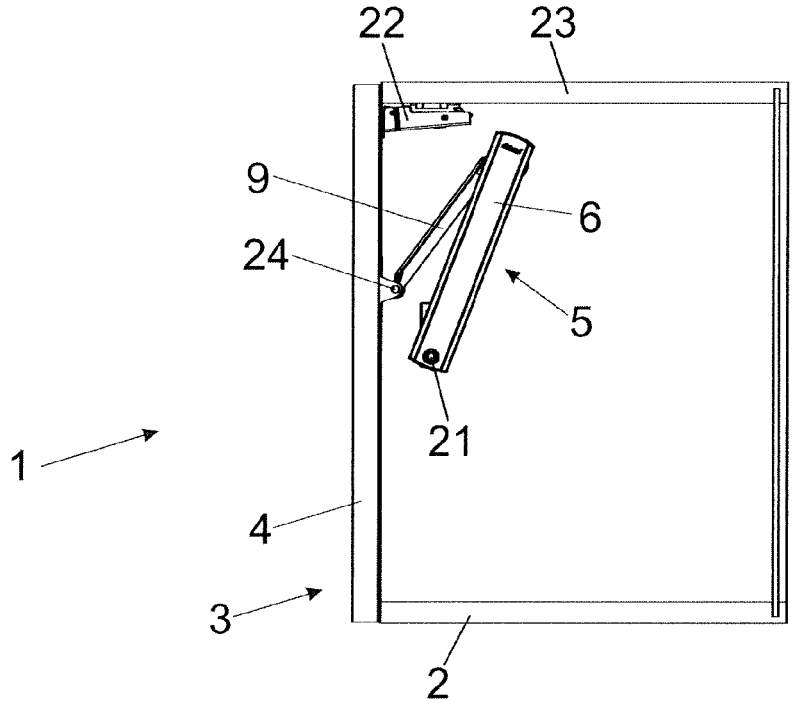
FIG. 1*a*, 1*b* show an item of furniture with an upwardly moving flap in a closed position and in an open position.
Figure 1B:
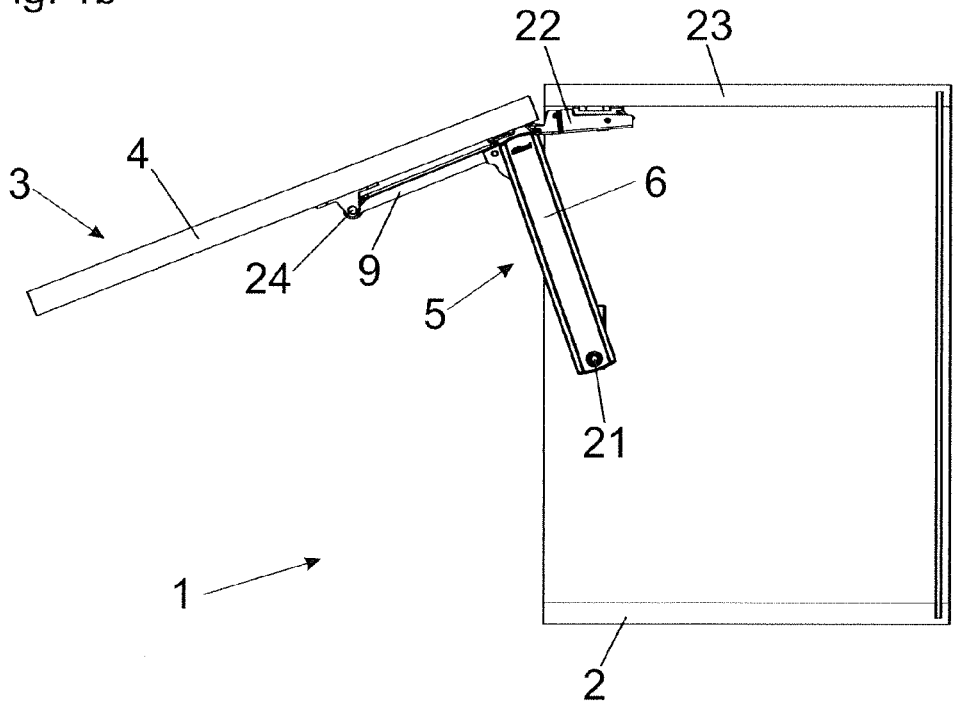

FIG. 1*a* shows a side view of an item of furniture 1 having a furniture carcass 2 and a movable furniture part 3 in the form of a flap 4 which is upwardly movable relative to the furniture carcass 2. FIG. 1*b* shows the item of furniture 1 with the flap 4 in an open position, wherein the flap 4 is pivotally mounted by way of hinges 22 relative to a cabinet top 23 of the furniture carcass 2. For moving the flap 4, an actuating drive 5 with a housing 6 is provided, the housing 6 is pivotally supported on the furniture carcass 2 on a bearing axis 21. The actuating drive 5 further includes an actuating arm 9 which, in the mounting position, is pivotally mounted about a horizontal extending pivoting axis 10. By way of the actuating drive 5, the flap 4 can be moved between a vertical closed position (FIG. 1*a*) and a swiveled-up open position which enables access to the furniture carcass 2 (FIG. 1*b*). The free end region of the actuating arm 9 is to be connected to the flap 4 by way of a hinge axis 24.

Figure 2:
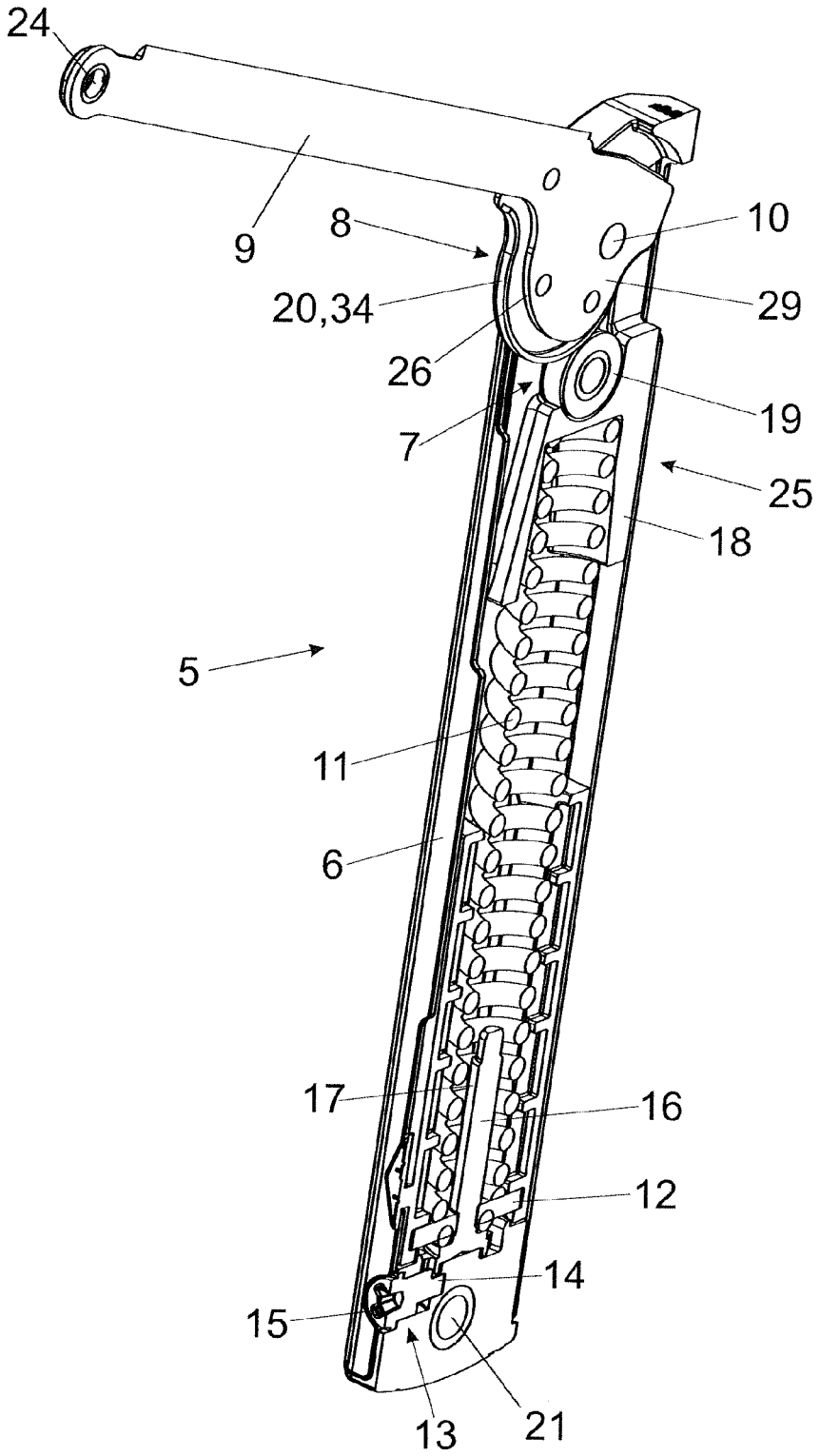
FIG. 2 shows a possible embodiment of an actuating drive in a perspective cross-section.

FIG. 2 shows the actuating drive 5 in a perspective cross-section, wherein the actuating arm 9 is pivotally mounted about a horizontally extending axis 10 in the mounting position. The actuating drive 5 includes a housing 6, in which a spring device 11 is accommodated, to be fastened to the furniture carcass 2. In the shown embodiment, the spring device 11 includes at least one coil spring in the form of a pressure spring. However, it is also possible to provide two or more—preferably arranged in parallel—coil springs. The spring device 11 is supported with an end onto a counter bearing in the form of an adjustable screw nut 12 which is in thread engagement with an adjusting screw 16. By way of an adjusting device 13, the torque acting on the actuating arm 9 can be adjusted. The adjusting device 13 includes an adjusting wheel 14 with an adapter 15 for receiving an actuating tool, wherein the adjusting wheel 14 interacts via a transmission, preferably a bevel gear, with the head of the adjusting screw 16. Upon a rotation of the adapter 15 by the actuating tool, the adjusting screw 16 can be rotated, whereby the screw nut 12 can be adjusted along the thread 17 of the adjusting screw 16. In this way, the spring device 11 can be variably compressed and thus the force of the spring device 11 acting on the actuating arm 9 can be variably adjusted. In the shown Figure, the screw nut 12 is in a position in which the spring device 11 is minimally pre-stressed, i.e. that the torque acting onto the actuating arm 9 is at its lowest.

For transmitting a force of the spring device 11 onto the actuating arm 9, a transmission mechanism 25 includes an actuating portion 29 which is movement-coupled to the actuating arm 9, and the actuating portion 29 is in the form of a cam section. The transmission mechanism 25 further includes a setting contour 20 and a pressure portion 7 in the form of a rotatably mounted pressure roller 19 which is pressurized by the spring device 11. The pressure roller 19, upon a movement of the actuating arm 9, can run (i.e. roll off) along the setting contour 20. The pressure roller 19 is supported on a slider 18 which is movable, preferably linearly displaceable, relative to the housing 6. In the shown embodiment, the actuating portion 29 together with the actuating arm 9 has a one-piece configuration, so that the pivoting axis 10 of the actuating portion 29 also forms the pivoting axis 10 of the actuating arm 9. Naturally, it is also possible to arrange the actuating portion 29 separate from the actuating arm 9, for example in the form of a pivotally mounted lever (not shown here) of the transmission mechanism 25 which is connected in a movement-coupled manner to the actuating arm 9. Thus, it is certainly possible to arrange the actuating portion 29 on a different position along the acting force-transmission path between the spring device 11 and the actuating arm 9.

As clearly visible in FIG. 2, the actuating portion 29 which is pivotable about the pivoting axis 10 includes a peripheral surface 26 which is radially spaced from the pivoting axis 10. Thus, the pressure portion 7 in the form of the pressure roller 19 does not directly rest against the peripheral surface 26 of the actuating portion 29, but rather against a setting contour 20 in the form of a curved outer surface 34 which is arranged on a contour portion 8 being separate from the actuating portion 29. The setting contour 20 of the contour portion 8 is arranged so as to at least partially cover the peripheral surface 26 of the actuating portion 29 which is radially spaced from the pivoting axis 10. The contour portion 8 can be formed as a bent metal portion or a deep-drawing portion which is inexpensive and easy to manufacture. The contour portion 8 forms, relative to the pivoting axis 10 of the actuating portion 29, an eccentric setting contour 20 affecting the movement behavior of the movable furniture part 3 in terms of force. The contour portion 8 is movement-coupled to the actuating arm 9, wherein upon a movement of the actuating arm 9, the contour portion 8 also pivots therewith. The setting contour 20 of the contour portion 8 forms a differing radial spacing relative to the pivoting axis 10 of the actuating portion 29. The setting contour 20 of the contour portion 8 is configured such that the actuating arm 9, at the end of the closing movement, is being pressed by the force of the spring device 11 into the final closed position. Upon an opening movement of the actuating arm 9, the pressure portion 7 in the form of the pressure roller 19 reaches an apex-position (that is to say the region of the setting contour 20 with the largest radial spacing in relation to the pivoting axis 10) so that the spring device 11, after passing a dead-center position, applies a torque onto the actuating arm 9 in the opening direction. For damping the closing- and/or opening movement of the actuating arm 9, a damper, in particular a fluid damper (not shown here), can also be provided.

Figure 3:
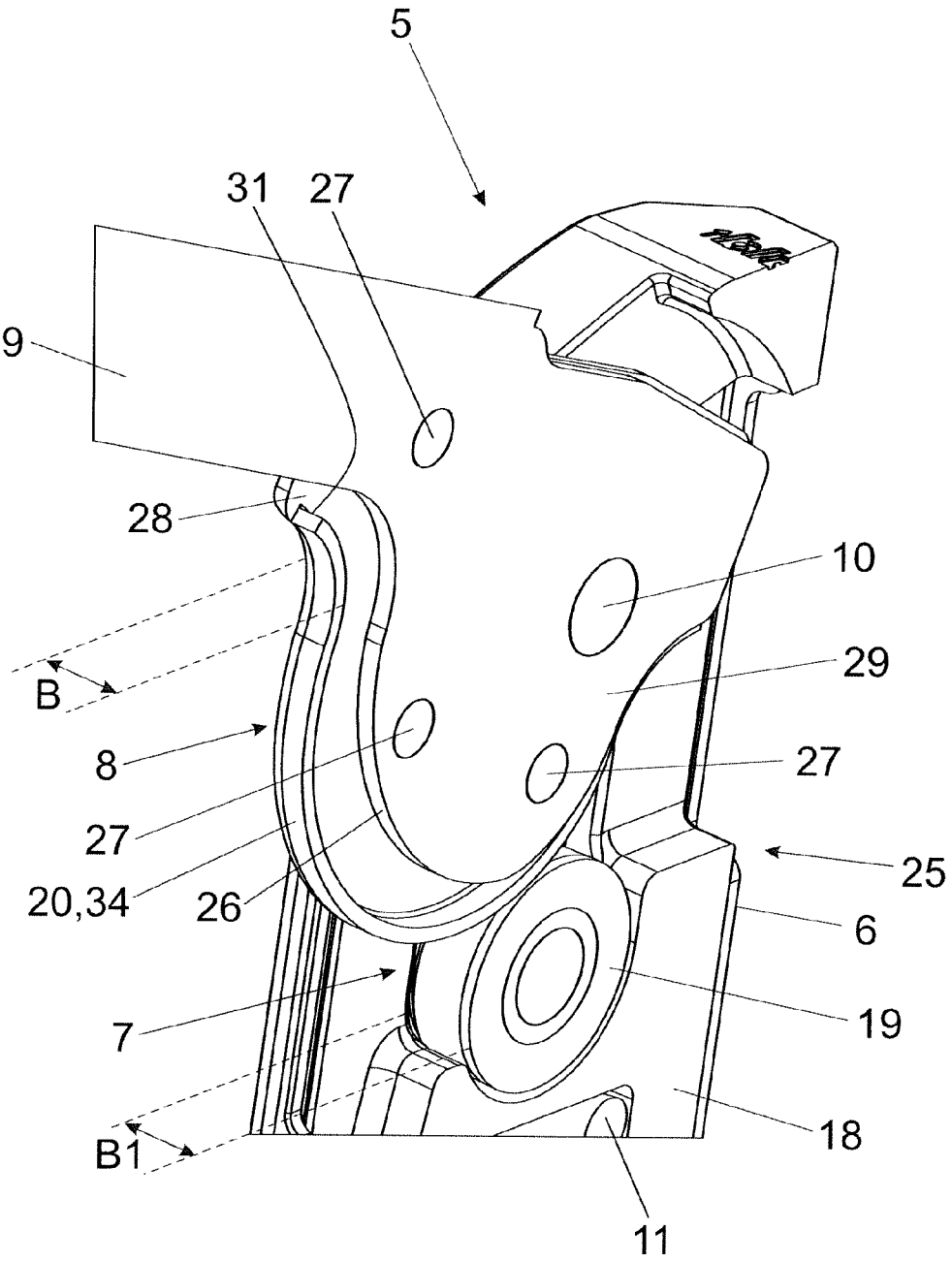
FIG. 3 shows a detail view of the actuating drive in a perspective cross-section.

FIG. 3 shows a detail view of the transmission mechanism 25 of the actuating drive 5. The actuating portion 29 being movement-coupled to the actuating arm 9 includes fastener(s) 27 which interact with corresponding fastening locations 30 (FIG. 4*b*) of the contour portion 8. The contour portion 8 has a fastening section 28 for laterally resting against the actuating portion 29 and a limb 31 protruding transversely from the fastening section 28, in which the setting contour 20 is formed by a curved radially outer surface 34 of the limb 31. The width B of the limb 31 which forms the setting contour 20 corresponds substantially to the width B1 of the pressure portion 7, and thus substantially corresponds to the width of the pressure roller 19. The spring device 11 presses against the slider 18 which is, together with the pressure portion 7 arranged thereon, linearly displaceable relative to the housing 6.

Figure 4A:
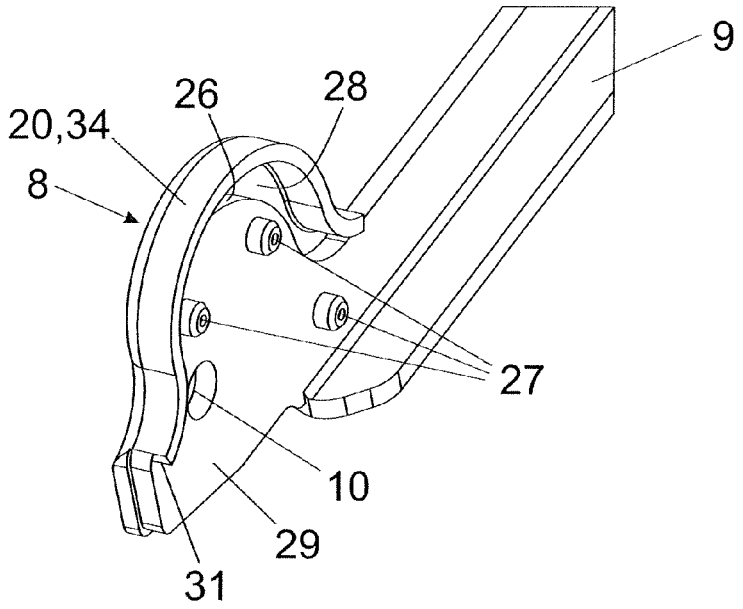
FIGS. 4*a*, 4*b* show two different variants of the arrangement of contour portions onto the actuating portion.
Figure 4B:
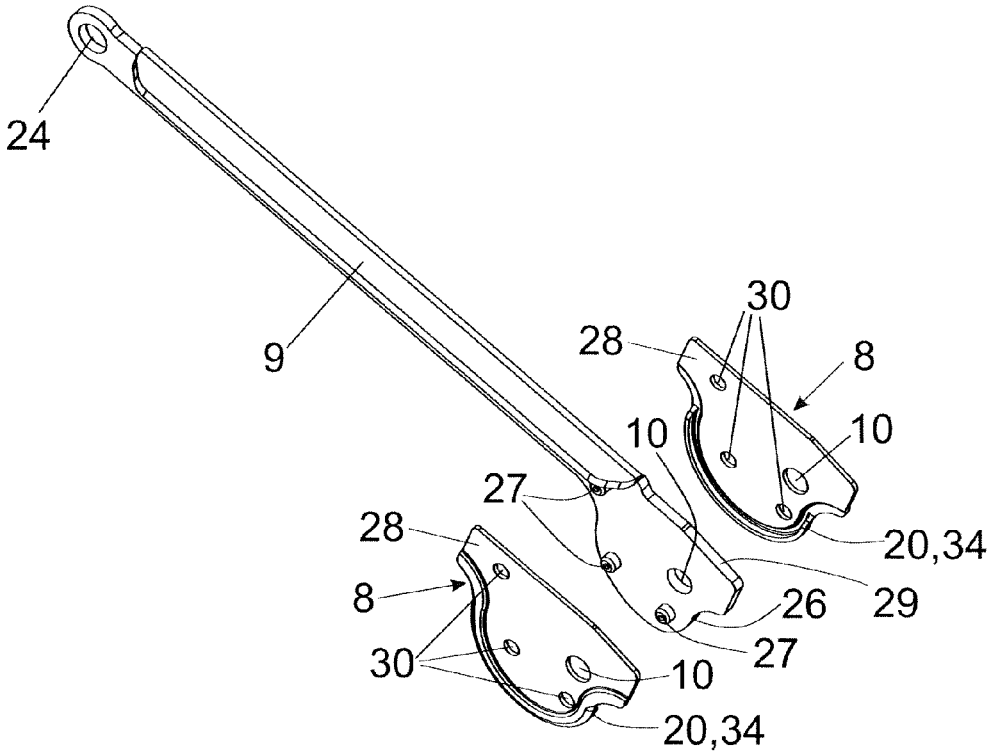

FIG. 4*a* and FIG. 4*b* show two different variants of the arrangement of contour portions 8 onto the actuating portion 29. The actuating portion 29 is pivotally mounted about the pivoting axis 10 and has a peripheral surface 26 which is radially spaced from the pivoting axis 10. In FIG. 4*a*, a contour portion 8 is fixed to only one side of the actuating portion 29. The contour portion 8 has a flat-shaped fastening section 28 which, in the mounted position, is configured to rest against a corresponding flat-shaped side surface of the actuating portion 29. The contour portion 8 further includes a limb 31 protruding laterally from the fastening section 28, wherein the setting contour 20 for the pressure portion 7 is formed by a curved outer surface 34 of the limb 31. By way of the setting contour 20 of the contour portion 8, the peripheral surface 26 of the actuating portion 8 is covered which does not necessarily mean that the inner side of the limb 31 facing towards the peripheral surface 26 needs to directly rest against the peripheral surface 26 of the actuating portion 29. It is preferable that the inner side and the outer side of the limb 31 each form a contour running parallel to the pivoting axis 10. The actuating portion 29 includes fastener(s) 27 which, in the mounted condition, interact with fastening locations 30 (FIG. 4*b*) of the contour portion 8. At least one or more fastening locations 30 of the contour portion 8 are eccentrically arranged in relation to the pivoting axis 10 of the actuating portion 29 so that the contour portion 8 is non-rotatably secured to the actuating portion 29 (i.e., the contour portion 8 cannot rotate relative to the actuating portion 29). The wall thickness of the at least one contour portion 8 is thereby configured to be substantially constant.

FIG. 4*b* shows a variant in which contour portions 8 with a curved outer surface 34 are arranged on both sides of the actuating portion 29. Thus, a first contour portion 8 is fixed to a first side of the actuating portion 29 and a second contour portion 8 is fixed to a second side of the actuating portion 29, and the setting contour 20 of the first contour portion 8 and the setting contour 20 of the second contour portion 8 (i.e. the edge regions of the limbs 31 of both contour portions 8) rest against each other and thereby cover at least partially the peripheral surface 26 of the actuating portion 29.

Figure 5A:
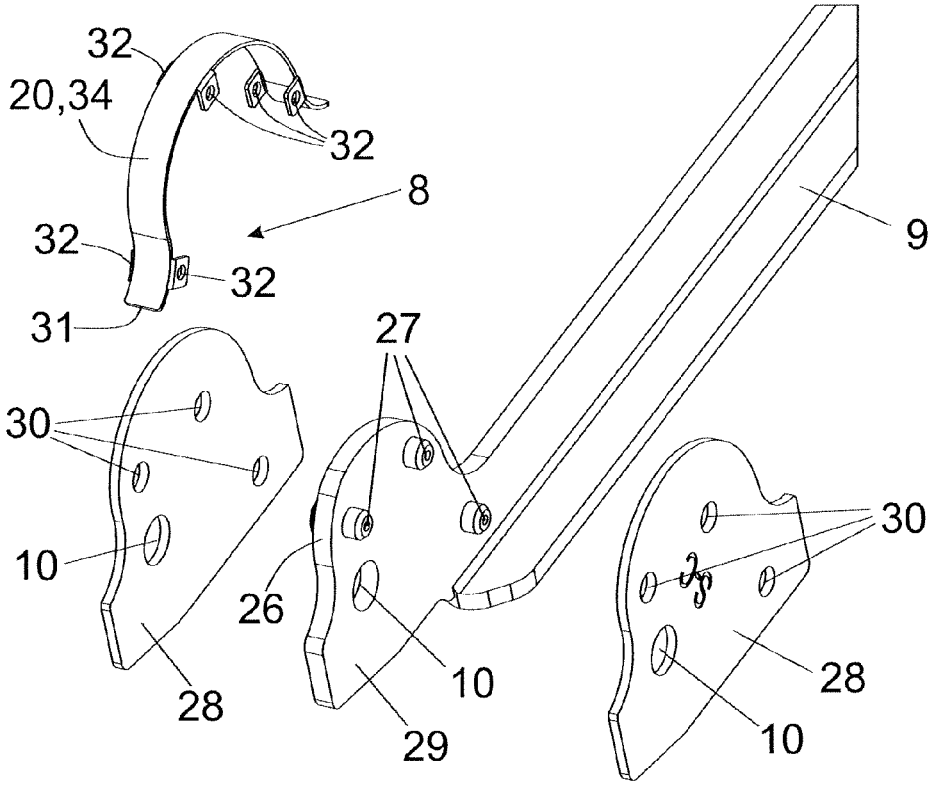
FIGS. 5*a*, 5*b* show an embodiment of a multi-part contour portion.

FIG. 5*a* shows a further embodiment of a multi-part contour portion 8, wherein the fastening section 28 and the limb 31 forming the setting contour 20 with the curved outer surface 34 are configured as separate components. In a first mounting step, both fastening sections 28 are fixed to the left and to the right onto the actuating portion 29, and so both fastening sections 28 accommodate the actuating portion 29 in their middle. The convex-bulged limb 31 includes several fastening locations 32 in the form of tabs which are configured to be fixed to both fastening sections 28.

Figure 5B:
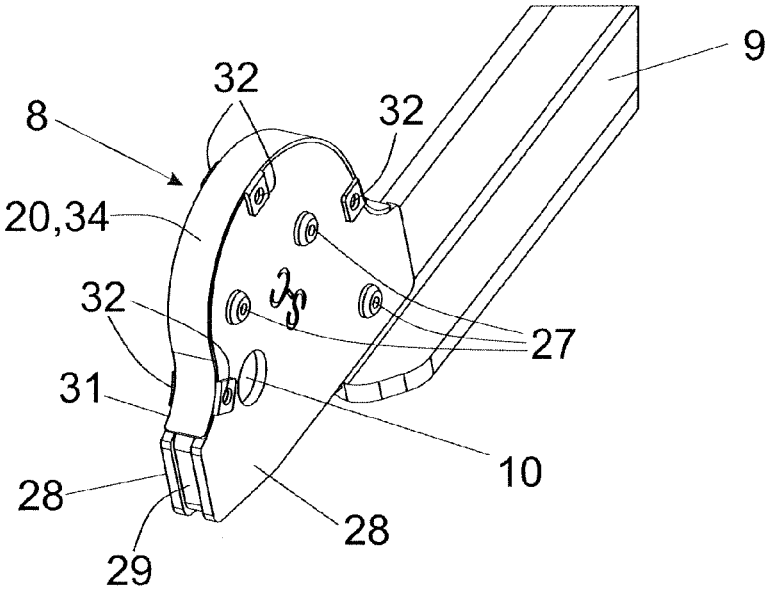

FIG. 5*b* shows the embodiment according to FIG. 5*a* in the mounted condition. The fastening locations 32 of the contour portion 8 are provided with openings which serve for the passage of bolts, screws or the like. It is, however, also possible that the actuating portion 29 includes a bearing location into which the limb 31 with the setting contour 20 can be inserted. Furthermore, a latching device can be spaced from the bearing location so that, due to the latching device, the limb 31 with the setting contour 20, after having been pivoted towards the actuating portion 29, can be latched, preferably releasable, therewith.

Figure 6A:
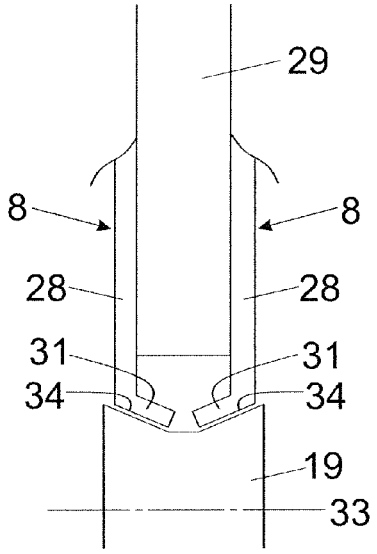
FIG. 6*a*-6*d* show an embodiment with a pressure roller in the form of a double-tapered roller.

FIGS. 6*a*-6*d* show an embodiment with a pressure roller 19 in the form of a double-tapered roller. As shown in FIG. 6*a*, the disc-shaped actuating portion 29 which is movement-coupled to the actuating arm 9 includes on both sides a contour portion 8 with a fastening section 28, and the limbs 31 each protrude transversely from the fastening sections 28 at an angle differing from 90°. The pressure roller 19 in the form of the double-tapered roller, which is rotatably mounted about the hinge axis 33, runs thereby along the curved outer surfaces 34 of the limbs 31.

Figure 6B:
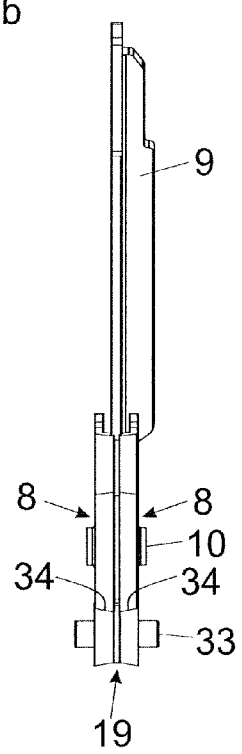
Figure 6C:
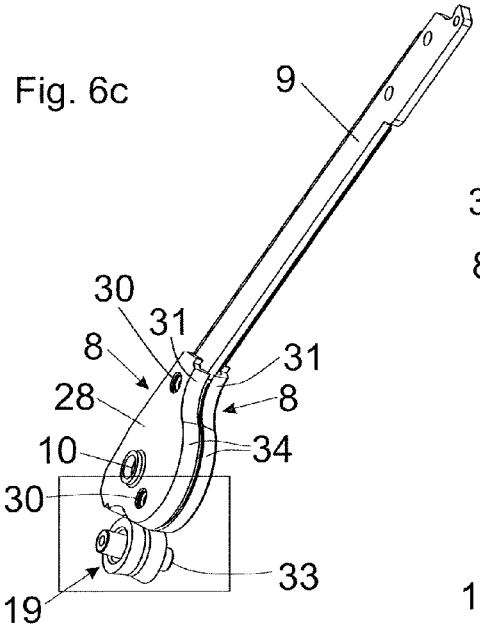
Figure 6D:
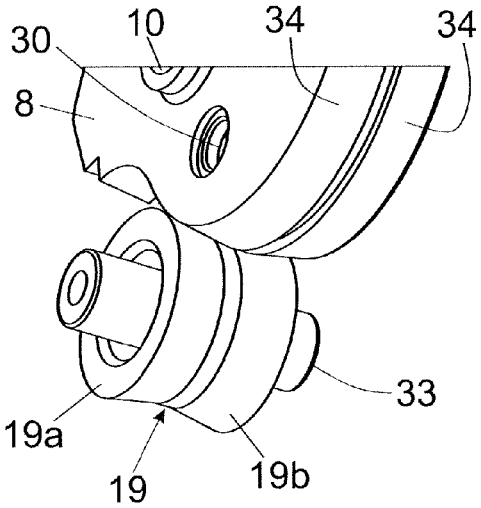

FIG. 6*b* shows a frontside view of the actuating arm 9 which is pivotally mounted about the pivoting axis 10, while FIG. 6*c* shows this construction in a perspective view. FIG. 6*d* shows the framed region of FIG. 6*c* in an enlarged view, and the pressure roller 19 in the form of the double-tapered roller is clearly visible. The double-tapered roller includes two, preferably identically shaped, truncated cones 19*a*, 19*b* which are connected to each other by their smaller bases. Thereby, the truncated cones 19*a*, 19*b* roll along the, in relation to the pivoting axis 10, curved outer surface 34 of the limbs 31. In this way, optimal centering of the pressure roller 19, a uniform distribution of pressure forces of the spring device 11 acting on the pressure roller 19 and a smooth running of the pressure roller 19 for the line contact with the smooth, curved outer surfaces 34 of the limbs 31 can be provided.

The invention claimed is:

1. An actuating drive for moving a movable furniture part, comprising:

an actuating arm pivotally mounted about a pivoting axis for moving the movable furniture part;

a spring device for applying a force to said actuating arm; and a transmission mechanism for transmitting a force from said spring device to said actuating arm, said transmission mechanism including:

an actuating portion movement-coupled to said actuating arm;

a contour portion separate from said actuating portion and formed of bent or deep-drawn metal, said contour portion having (a) a fastening section configured to rest against said actuating portion, and (b) a limb protruding transversely from said fastening section such that a setting contour is formed by a curved radially outer surface of said limb; and a pressure portion pressurized by said spring device, said pressure portion being a rotatably mounted pressure roller configured to run along said setting contour upon a movement of said actuating arm, said setting contour being arranged between said actuating portion and said pressure roller.

2. The actuating drive according to claim 1, wherein said limb of said contour portion protrudes transversely from said fastening section of said contour portion in a direction parallel to said pivoting axis of said actuating arm.

3. The actuating drive according to claim 1, wherein said limb has a width corresponding to a width of said pressure roller.

4. The actuating drive according to claim 1, wherein said fastening section of said contour portion includes a fastening location for fixing said contour portion to said actuating portion.

5. The actuating drive according to claim 4, wherein said fastening location is arranged eccentrically in relation to said pivoting axis of said actuating portion.

6. The actuating drive according to claim 1, wherein said contour portion is movement-coupled to said actuating portion such that, upon a movement of said actuating portion, said contour portion also moves with said actuating portion.

7. The actuating drive according to claim 1, wherein said actuating portion is pivotally mounted about an actuating pivoting axis.

8. The actuating drive according to claim 7, wherein said actuating pivoting axis is also said pivoting axis of said actuating arm.

9. The actuating drive according to claim 7, wherein said actuating portion has a peripheral surface on an end region facing towards said actuating pivoting axis, said peripheral surface being radially spaced from said actuating pivoting axis, said peripheral surface being at least partly covered by said limb and setting contour of said contour portion.

10. The actuating drive according to claim 9, wherein said contour portion is a first contour portion fixed to a first side of said actuating portion, said actuating drive further comprising a second contour portion fixed to a second side of said actuating portion, said setting contour of said first contour portion and a setting contour of said second contour portion being arranged to rest against each other and thereby at least partly cover said peripheral surface of said actuating portion.

11. The actuating drive according to claim 1, wherein said actuating portion is located on said actuating arm.

12. The actuating drive according to claim 1, wherein said spring device includes a coil spring.

13. The actuating drive according to claim 12, wherein said coil spring is a pressure spring.

14. The actuating drive according to claim 1, wherein said pivoting axis of said actuating arm is configured to extend in a horizontal direction in a mounting position, and said pivoting axis and said spring device are configured such that said spring device acts upon said actuating arm about said pivoting axis in an opening direction.

15. The actuating drive according to claim 1, wherein said pressure roller is a double-tapered roller having two tapered cones connected to each other.

16. The actuating drive according to claim 15, wherein said tapered cones are connected to each other by respective bases.

17. An arrangement comprising:

a movable furniture part; and said actuating drive according to claim 16 for moving said movable furniture part.

* * * * *